United States Patent [19]

Yamamoto

[11] Patent Number: 4,614,271

[45] **Date of Patent: * Sep. 30, 1986**

[54] SEPARATING ELEMENT FOR VIBRATORY GRAIN SEPARATOR

[76] Inventor: Shoichi Yamamoto, 813-17 Oaza Tendou Kow, Tendou-shi, Yamagata-ken, Japan

[ * ] Notice: The portion of the term of this patent subsequent to Apr. 22, 2003 has been disclaimed.

[21] Appl. No.: 645,853

[22] Filed: Aug. 31, 1984

Related U.S. Application Data

[62] Division of Ser. No. 522,029, Aug. 11, 1983, Pat. No. 4,577,552.

[30] Foreign Application Priority Data

Jun. 17, 1983 [JP] Japan ..... 58-108889

[51] Int. Cl.[4] ..... B07D 13/10

[52] U.S. Cl. ..... 209/694; 209/481; 209/485; 209/695

[58] Field of Search ..... 209/691, 694, 695, 485, 209/479–481

[56] References Cited

U.S. PATENT DOCUMENTS

| | | | |
|---|---|---|---|
| 882,156 | 3/1908 | MacDonald | 209/481 |
| 948,222 | 2/1910 | Honabach | 209/480 |
| 2,574,010 | 11/1951 | Bjorndahl | 209/481 |
| 3,807,554 | 4/1974 | Satake | 209/694 |
| 4,316,799 | 2/1982 | Satake | 209/480 X |

FOREIGN PATENT DOCUMENTS

| | | | |
|---|---|---|---|
| 134498 | 10/1949 | Australia | 209/479 |
| 446323 | 4/1975 | U.S.S.R. | 209/691 |

*Primary Examiner*—Robert B. Reeves
*Assistant Examiner*—Donald T. Hajec
*Attorney, Agent, or Firm*—Shlesinger, Fitzsimmons & Shlesinger

[57] ABSTRACT

A rectangularly shaped separating element for a vibratory grain separator is made from a single metal plate, and has upright front and rear walls, and side walls, one of which side walls has therein a notch serving as hulled rice outlet, and the other of which has therein a notch servicing as an unhulled rice outlet. The plane, upper surface of the separating element has formed thereon a first plurality of spaced protuberances inclined obliquely to the front wall and the sidewall containing the rice outlet for moving the hulled rice toward the hulled rice outlet, and a second plurality of protuberances inclined obliquely to the front wall and the other side wall for moving the unhulled rice toward the unhulled rice outlet.

2 Claims, 19 Drawing Figures

8
9
10
2
34
3
44
43
7
35
108
87
4
6
1
47

SEPARATING ELEMENT FOR VIBRATORY GRAIN SEPARATOR

This application is a division of my pending U.S. application Ser. No. 06/522,029, filed Aug. 11, 1983, now U.S. Pat. No. 4,577,552 for Rice Hulling Apparatus.

DETAILED DESCRIPTION OF THE INVENTION

This invention relates to a rice-hulling apparatus.

The primary object of the present invention is to provide a rice-hulling apparatus, which is far simpler in construction than the prior art rice-hulling apparatus of the same kind.

Another object of the present invention is to provide a rice-hulling apparatus, which is far simpler in construction and more inexpensive than the prior art rice-hulling apparatus of the same kind.

A further object of the present invention is to provide a rice-hulling apparatus, which can satisfactorily air-blow separate the process grain.

A still further object of the present invention is to provide a rice-hulling apparatus, which has a reduced height.

A yet further object of the present invention is to provide a rice-hulling apparatus, which does not use any screw conveyor so that high quality product free from skin scratches can be obtained.

A prior art rice-hulling apparatus pertaining to the present invention is as shown in FIG. 1.

The apparatus has a supply hopper A, into which the material of unhulled rice a is charged by raising a grain sack. A hulling section B is disposed beneath the supply hopper A. It has a pair of parallel rubber rollers C rotatably mounted inside it. An air-blow separating section D is disposed beneath the hulling section B. In the separating section D, hulls C which are light in weight are removed by air-blow, and the resultant rice including hulled and unhulled rice b and a is led sidewise to enter a lower portion of a mixture rice lift E provided on one side of the separating section D. A tank F which is commonly termed adjustable tank is suspended by a spring at the top of the lift E. Its vertical position is variable according to the quantity of mixture rice stored in it; it is lowered with increase of the mixture rice stored in it and raised with decrease of the stored mixture rice. A valve provided at the outlet of the supply hopper A is opened and closed in an interlocked relation to the vertical movement of the tank F by means of a wire. The mixture rice in the adjustable tank F led to a vibratory separator G where the hulled rice b and unhulled rice a are separated. The separated unhulled rice a is returned to the supply hopper A through a thrower H. The hulled rice b is led as finished rice to a lifter I to be taken out. Part of the mixture rice that is incapable of separation is led to the lower end of the lifter E for re-circulation.

The prior art rice hulling apparatus described above has the following drawbacks.

(a) The supply hopper A is disposed at a high level, so that the unhulled rice a must be raised for a great height distance for supplying it into the hopper A.

(b) The adjustable tank F suspended by the spring complicates the construction of the apparatus and increases the height thereof.

(c) The thrower H for returning unhulled rice is necessary.

(d) The whole apparatus is thus inevitably large in size.

(e) The distribution of mixture rice to a plurality of separating elements in the vibratory separator G toward the end of the operation is insufficient.

REFERRING TO THE DRAWINGS

Figure 1:
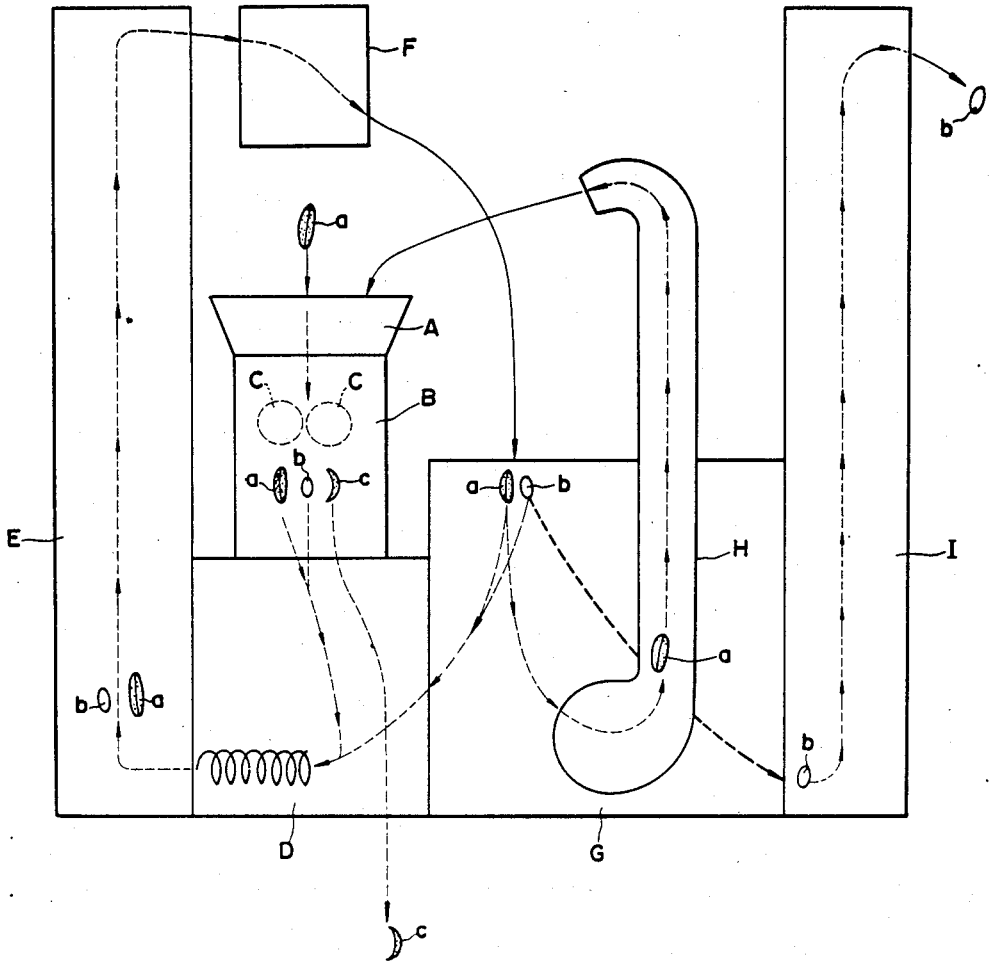
FIG. 1 PRIOR ART
FIG. 1 is a schematic view showing a prior art rice-hulling apparatus.
Figure 2:
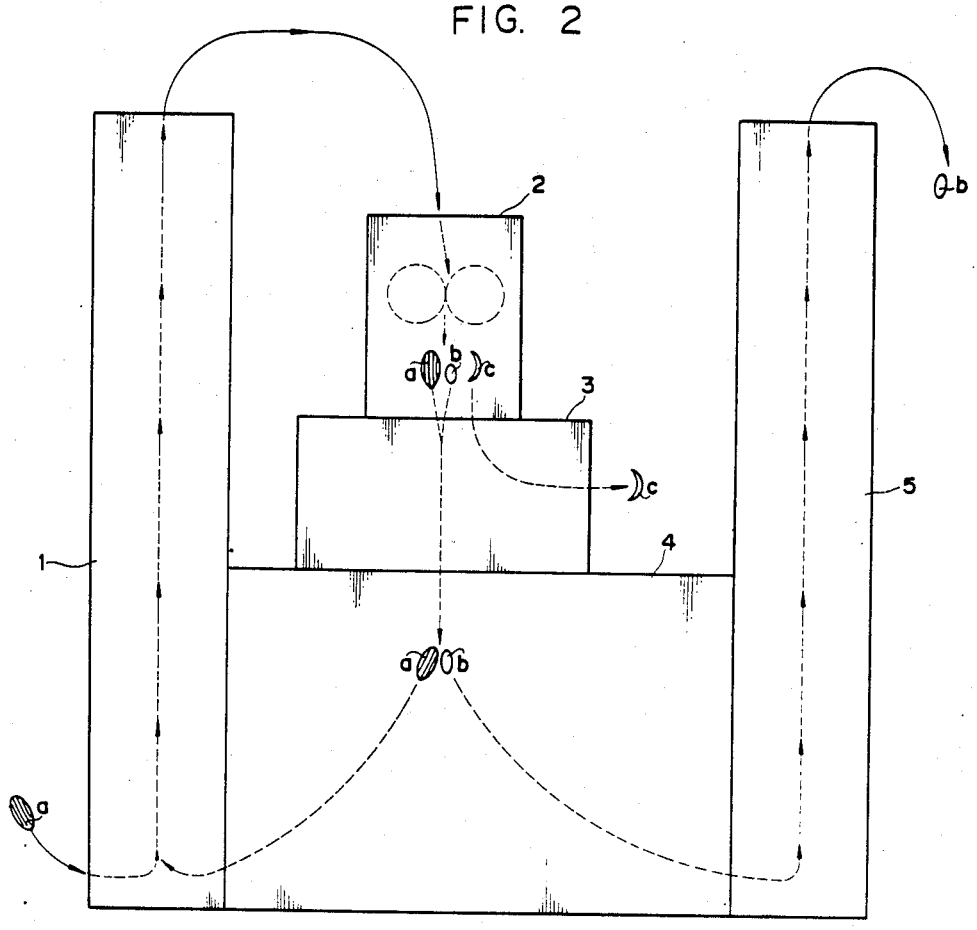
FIG. 2 is a schematic view showing a rice-hulling apparatus according to the present invention.

Referring now to FIG. 2, there is shown a rice-hulling apparatus according to the present invention. The apparatus comprises a lifter 1 for supplying unhulled rice a, a hulling section 2, an air-blow separating section 3, a vibratory separator 4 and a hulled rice take-out lifter 5. It does not have the tank F suspended by the spring and the thrower H for returning unhulled rice in the prior art apparatus of FIG. 1.

Figure 3:
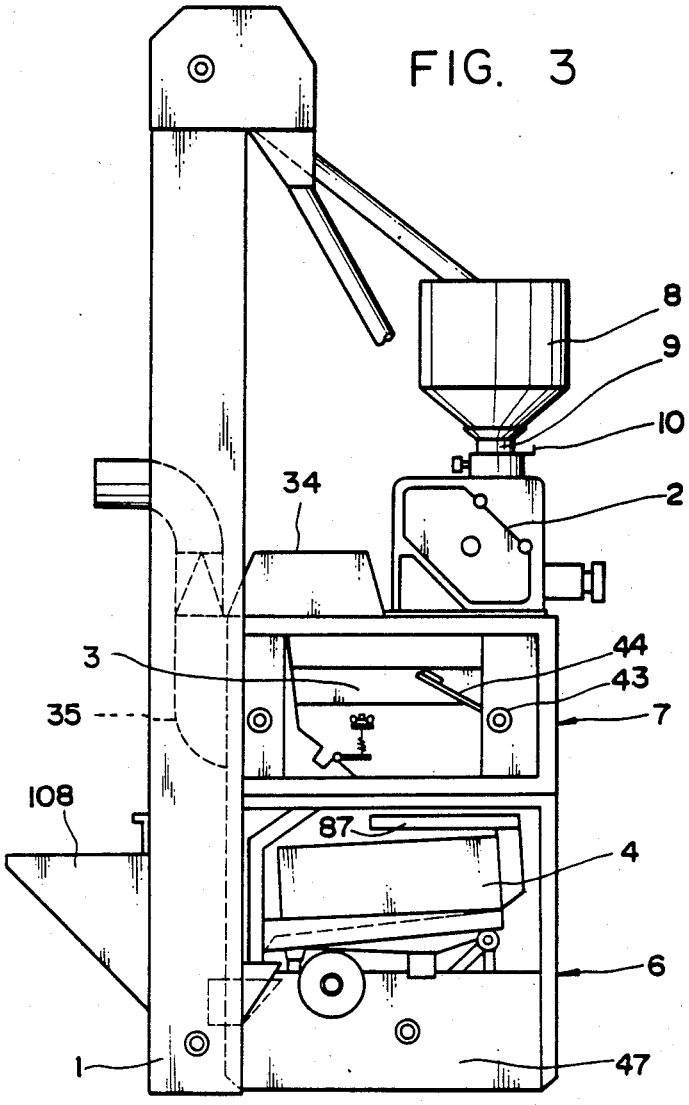
FIG. 3 is a side view showing the same rice-hulling apparatus.

Referring now to FIG. 3 and following Figures, the vibratory separator 4 has a frame 6, in which a multi-element vibratory separating section is provided. The air-blow separating section 3 has a frame 7, which is disposed on the frame 6 of the vibratory separator 4. The frames 6 and 7 are substantially the same in size and rectangular in shape. They are formed from angle steel. The hulling section 2 is provided on a portion of the top of the frame 7. A supply tank 8 is mounted on top of the hulling section 2. The supply tank 8 has a lower neck 9. An adjustment valve 10 is mounted in the neck 9. Beneath the adjustment valve 10, an adjuster 11 is mounted on a shaft 12. It can be rotated about the shaft 12 by turning an adjustment screw 13. It carries a delivery roller 14, which is driven by a motor for delivering the supplied unhulled rice a, such that the rice a strikes an inclined plate 15 disposed beneath the roller 14. From the inclined plate 15, the supplied unhulled rice a is led into between pair rubber rollers 16 and 17, which serve as hulling rollers.

Figure 7:
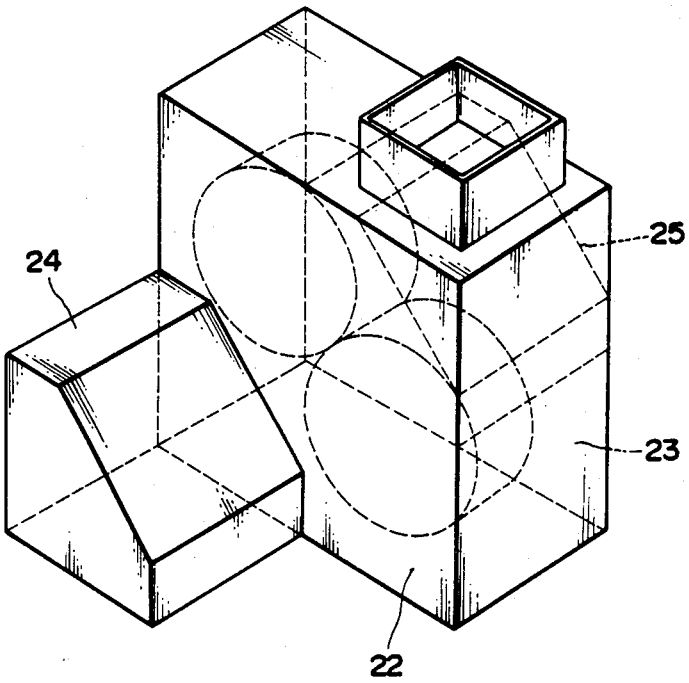
FIG. 7 is a perspective view showing a hulling section.
Figure 8:
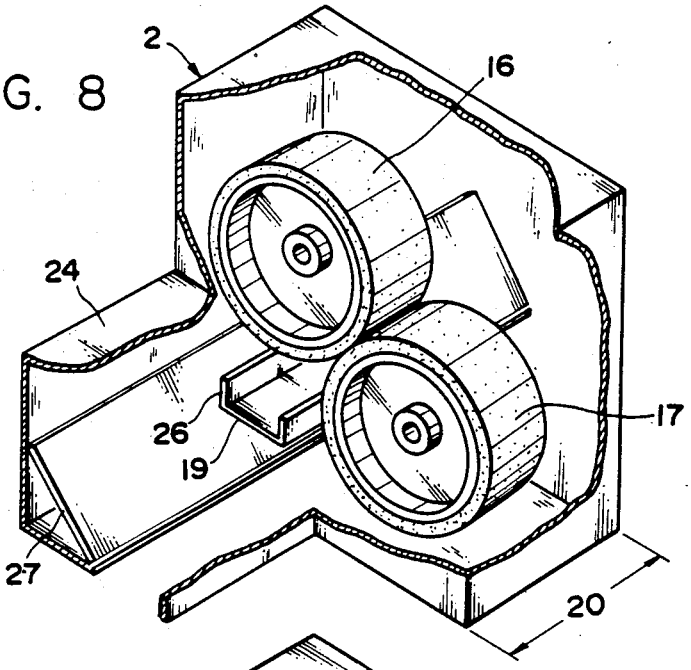
FIG. 8 is a perspective view, partly broken away, showing the hulling section.
Figure 9:
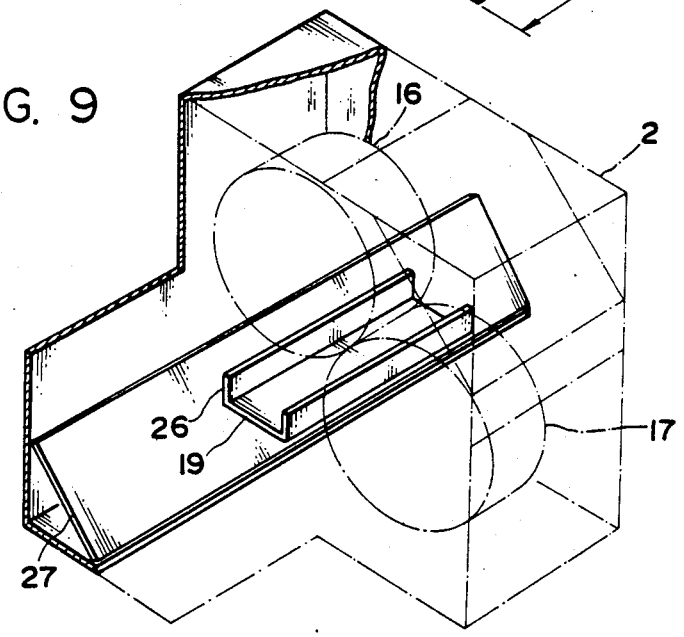
FIG. 9 is a perspective view showing the hulling section with hulling rollers removed.

The pair rubber rollers 16 and 17 are disposed in obliquely upper and lower positions, respectively. A dispersing member 19 (FIGS. 4A, 4B, 8, 9) having a gutter-like shape is provided beneath the discharge side 18 of the rubber rollers 16 and 17. What emerges from between the rubber rollers 16 and 17 strongly strikes the dispersing member 19 so that it is dispersed in the direction of the axes of the rubber rollers. The hulling section 2 has a width 20 (FIG. 10A) just enough to accommodate the rubber rollers 16 and 17, which width 20 is very small compared to the width 21 (FIG. 10A) of an air-blow separating casing 111 (FIGS. 4A, 4B, 5A, 5B) in the air-blow separating section 3 to be described as is well known in the art. Accordingly, dispersing space covers 24 and 25 (FIGS. 7, 8) are connected to and project laterally from notched portions of the opposite side walls 22 and 23 of the frame of the hulling section 2 such that the dispersing member 19 extends in these covers 24 and 25 as well as in the main frame of the hulling section 2. The matter emerging from between the rubber rollers 16 and 17 and striking the dispersing member 19 is thus dispersed uniformly over a dimension corresponding to the width 21 of the frame 7 of the air-blow separating section 3. The matter striking the dispersing member 19 jumps forwardly beyond the front upright edge 26 (FIGS. 4A, 4B) of the dispersing member 19. A reflector 27 is accordingly provided in front of the dispersing member 19. The jumping matter from the dispersing member 19 is reflected rearwardly by the reflector 27. At this time, it is dispersed in the full spaces in the covers 24 and 25.

The air-blow separating casing 111, which is provided in the frame 7 of the air-blow separating section 3, has inclined guide members 28 and 29, onto which the process grain reflected from the reflector 7 falls. A transversal air flow blower 30 mounted in a shaft 31 beneath the inclined guide members 28 and 29. The air-blow separating casing 111 has an air inlet opening 32, through which air is withdrawn by the transversal air flow blower 30. The inclined guide members 28 and 29 have gentle slopes so that the process grain falling on them will not substantially flow along them unless it is forced. There are two reasons for making the slope of the inclined guide members 28 and 29 gentle. The first reason is to reduce the height of the rice-hulling apparatus. The second reason is to cause dispersion of the unhulled rice in the width direction of the apparatus. As the air-blow separating casing 111 is finely vibrated, the process grain is moved over the inclined guide members 28 and 29 to be supplied to a lower air-blow separating chamber 33.

In the air-blow separating chamber 33, air is blown against the process grain falling from the inclined guide members 28 and 29. A hull withdrawal duct 34 for withdrawing the hull c is formed on top of the air-blow separating chamber 33. The hull withdrawal duct 34 is connected to a blower 35. The hull c is thus discharged to the outside of the apparatus through the hull withdrawal duct 34 and blower 35.

Figure 4A:
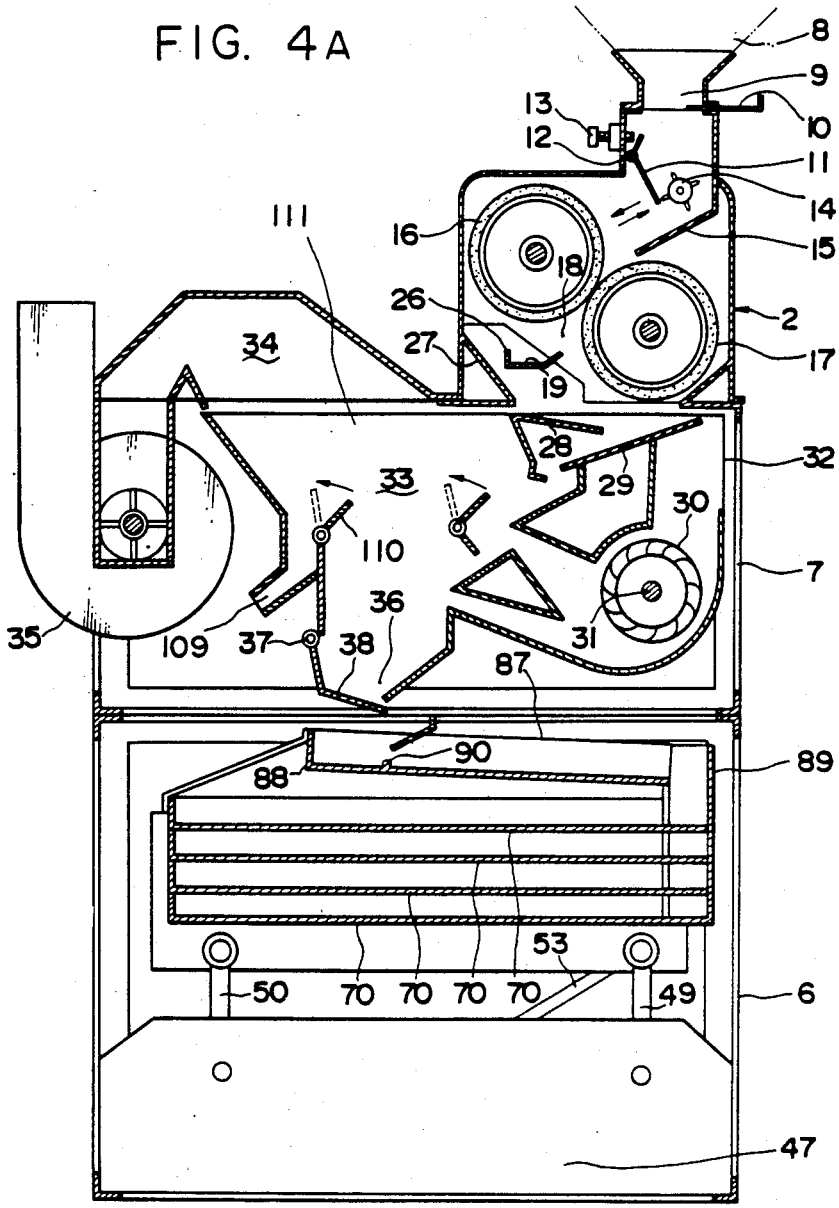
FIG. 4A is a longitudinal cross-sectional view showing a first embodiment of the present invention.
Figure 4B:
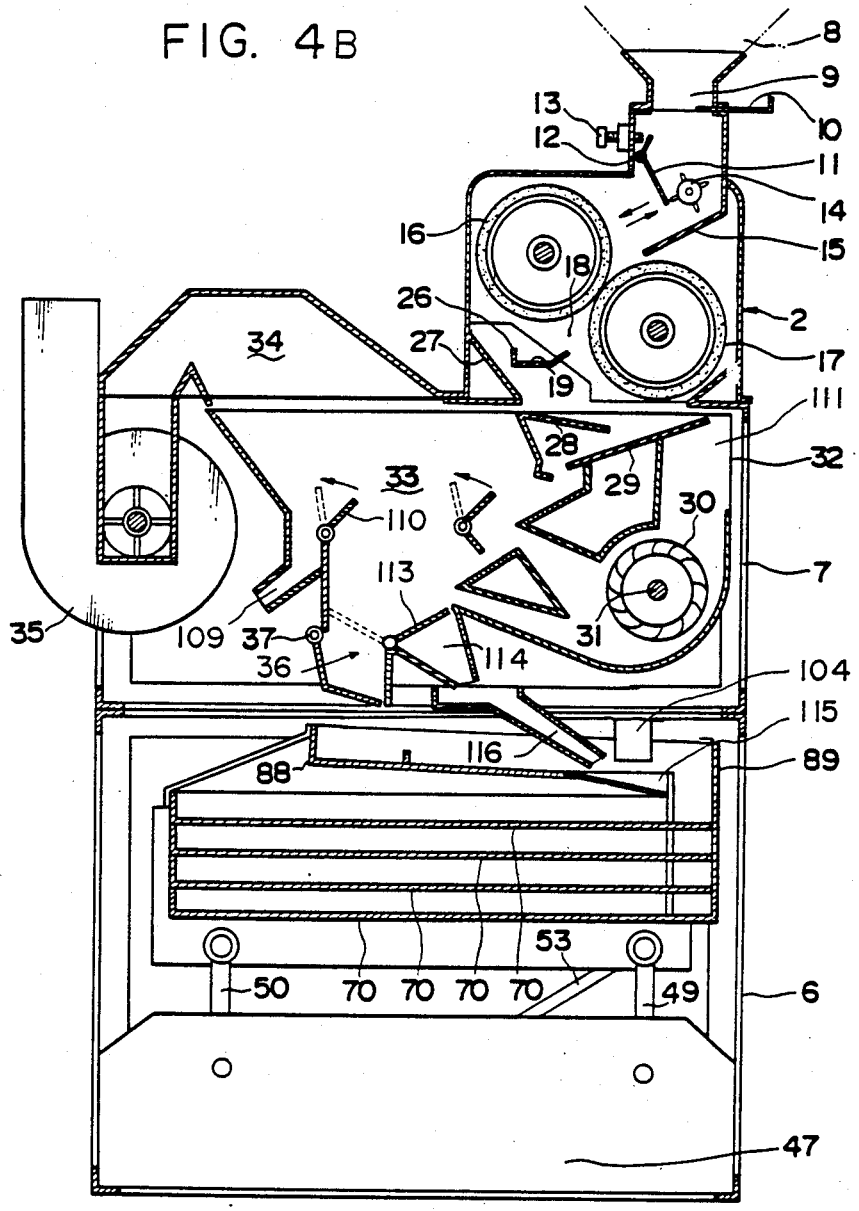
FIG. 4B is a view similar to FIG. 4A but showing a second embodiment of the present invention.
Figure 5A:
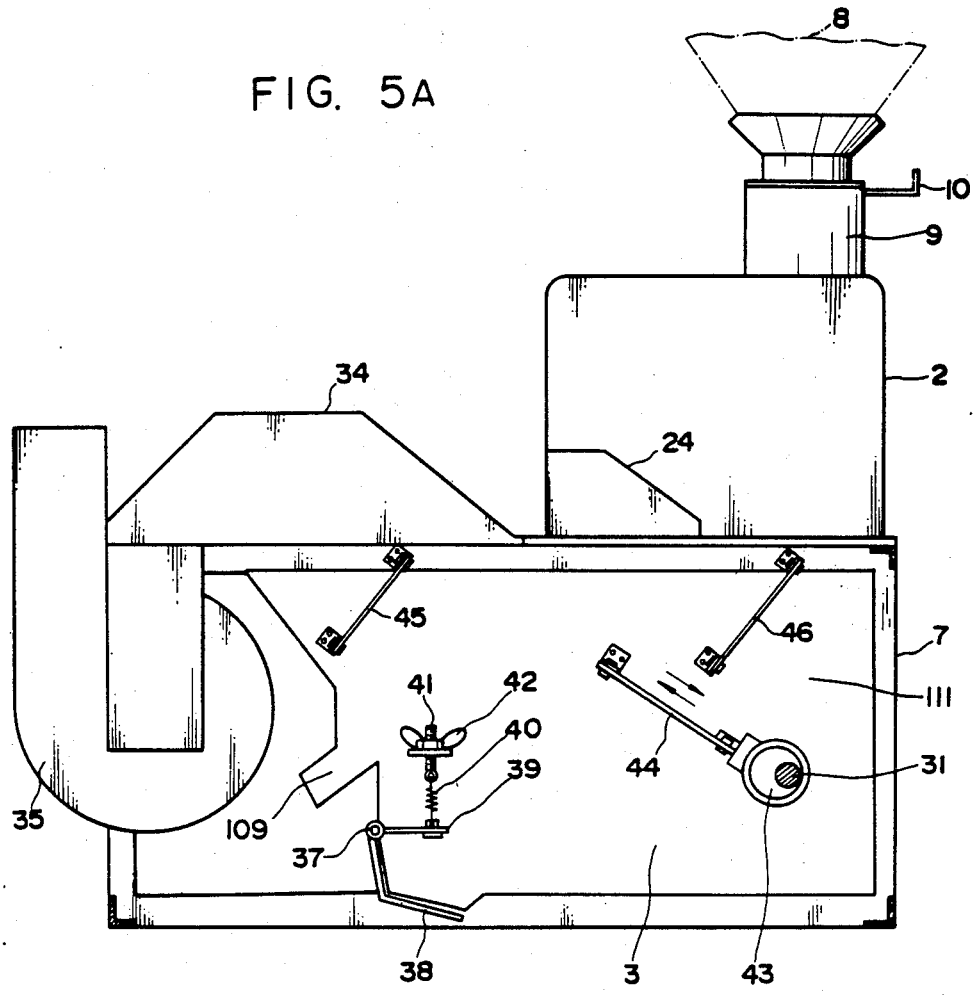
FIG. 5A is a side view showing a hulling section, an air-blow separating section, a supply tank and dispersing space covers.
Figure 5B:
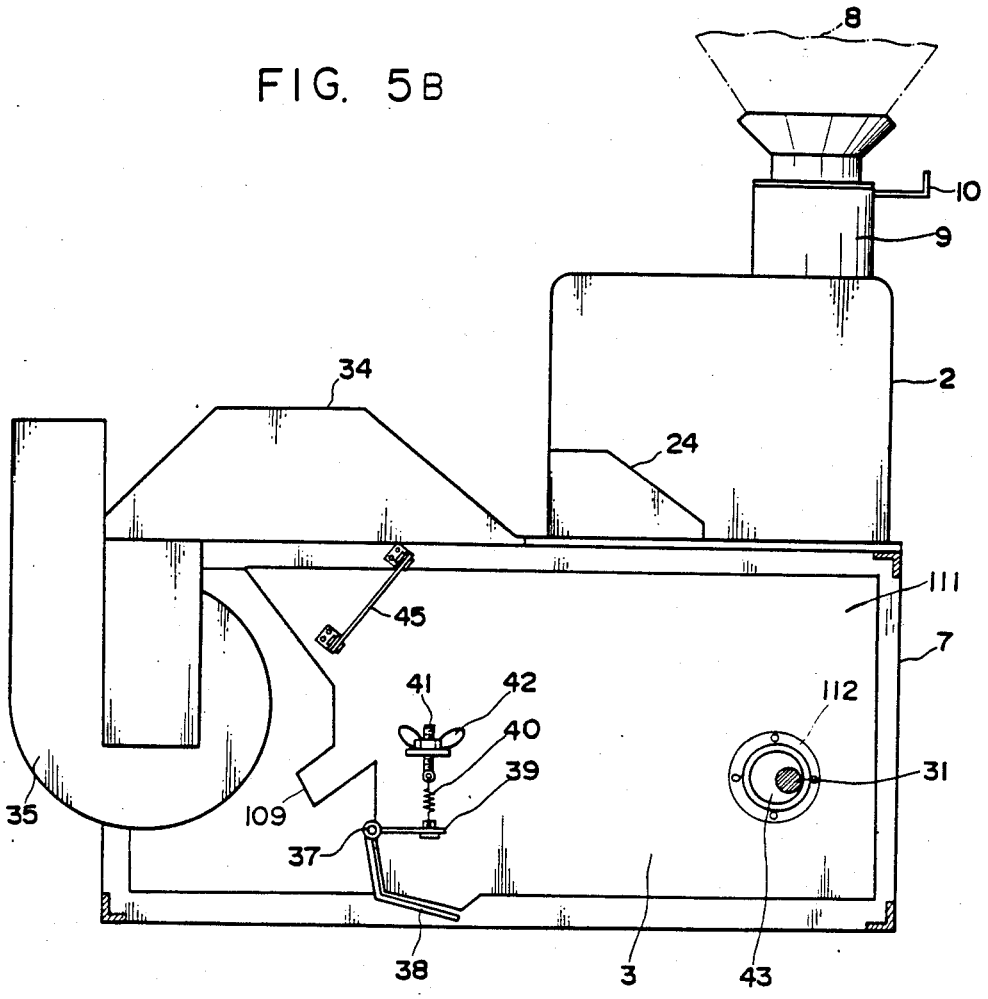
FIG. 5B is a view similar to FIG. 5A but showing a different example.
Figure 6:
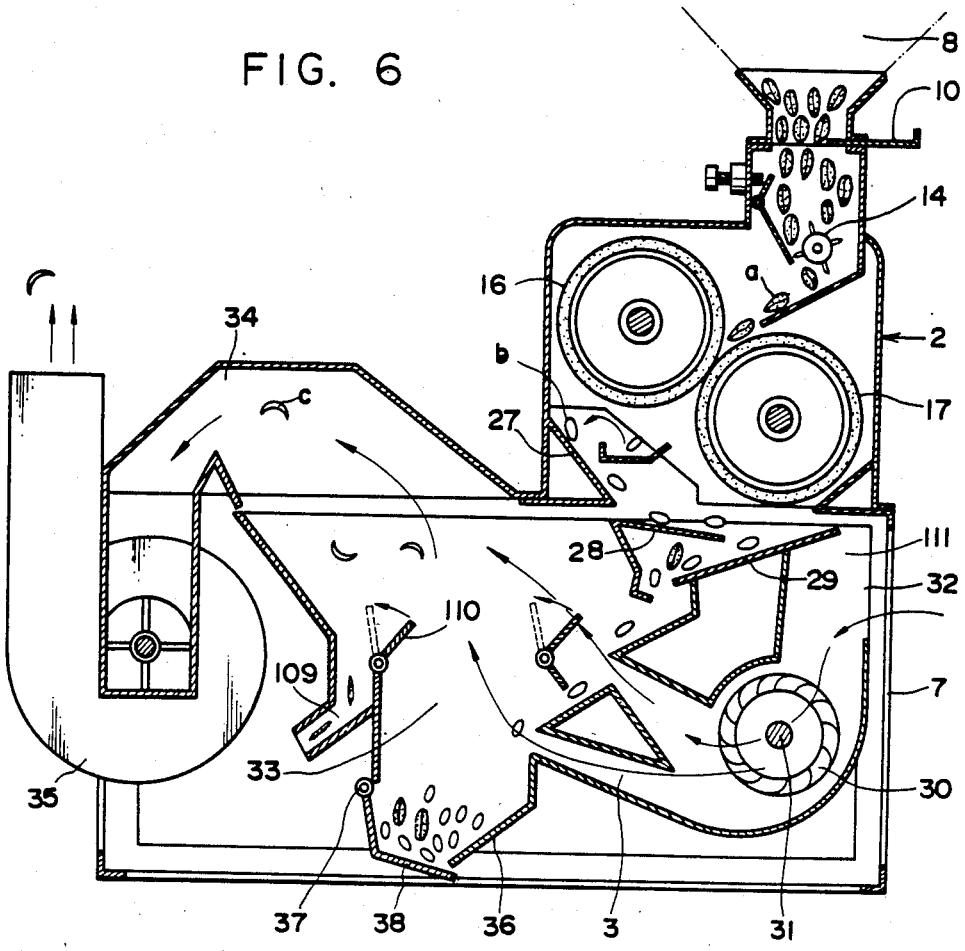
FIG. 6 is a longitudinal cross-sectional view showing the example of FIG. 5A.

FIGS. 4A and 4B show different examples of the air-blow separating chamber 33. In the example of FIG. 4A, a hopper 36 is formed at the bottom. It has an opening extending in the direction of the width 21 (see FIG. 10A). It consists of two opposing members, one of which constitutes an on-off valve 38 with the top thereof rotatably mounted on a shaft 37. The on-off valve 38 can be rotated about the shaft 37 to cause the process grain to fall uniformly in the width direction. Further, as shown in FIGS. 5A and 5B, a horizontally extending arm 39 is provided on the shaft 37. An adjustment screw 41 is coupled by a spring 40 to the arm 39. An adjustment nut 42 is fitted on the adjustment screw 41.

The example of FIG. 4B has a hopper 36, like that of the example of FIG. 4A, leading to a distributor 87 to be described, and also a passage 114 leading to the uppermost one of a plurality of separating elements 70 to be described later. It further has a change-over valve 113 for switching the hopper 36 and passage 114.

FIGS. 5A and 5B show respective examples of the arrangement for causing fine vibrations of the air-blow separating casing 111. In the example of FIG. 5A, an eccentric cam 43 is mounted on the shaft 31. A connecting rod 44 is secured at one end to the outer periphery of the eccentric cam 43 and secured at the other end to a side wall of the air-blow separating casing 111. The air-blow separating casing 111 is suspended from the frame 7 by inclined rods 45 and 46 such that it can vibrate finely. With the shaft 31 rotated at a high speed, the air-blow separating casing 111 is vibrated finely and quickly.

The example of FIG. 5B does not use the connecting rod 44 and inclined rod 46, but an outer ring 112 of eccentric cam 43 is secured to the side wall of the air-blow separating casing 111. The vibrating mechanism is thus greatly simplified.

The vibratory separator 4 provided in the frame 6 will now be described. It has a lower frame 47 (FIGS. 4A, 4B, 10–12). A base member 48 is coupled adjacent opposite ends thereof by arm 49 and 50 to the top of the frame 47. An eccentric cam 52 is mounted on a drive shaft 51. The eccentric cam 52 has a rod 53, which is pivoted to the base member 48 at a position coaxially of the upper ends of arms 49.

Figure 12:
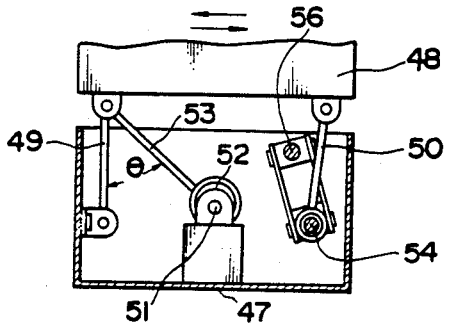
FIG. 12 is a left side view of the same section.

As shown in FIG. 12, the angle $\theta$ between the arm 49 and rod 53 is smaller than the right angles. The rotation of the eccentric cam 52, as noted hereinafter, has an effect of causing a quick return of the base member 48. The ratio of the return speed to the forward speed is suitably in a range of 1:1.01–1.2.

The lower ends of the arms 50 are mounted on a vertically movable shaft 54, which has its opposite ends received for vertical movement in vertical guide grooves 55 provided in the lower frame 47. A rotary shaft 56, which is only rotatable in frame 47, extends over and parallel to the vertically movable shaft 54. The rotary shaft 56 has oppositely cut threads 57 and 58 formed on the opposite sides of its axial center. Female thread members 59 and 60 are fitted on the respective threads 57 and 58.

Bosses 61 and 62 are mounted on the vertically movable shaft 54 at positions thereof outwardly of the female thread members 59 and 60. The female thread member 59 and boss 61 are coupled together by a rod 63, while the other female thread member and boss 62 are coupled together by a rod 64. The rotary shaft 56 is manually rotatable by operating a handle 65. The low frame 47 carries a reversible motor 66, the shaft of which has a sprocket 67. A sprocket 68 provided on the rotary shaft 56 and the sprocket 67 are coupled together by an endless chain 69. The rotary shaft 56 can also be automatically rotated by sensors provided on separating elements. With the rotation of the rotary shaft 56, the rods 63 and 64 are caused to gradually become upright from an inclined state. With this motion of the rods 63 and 64 the vertically movable shaft 54 is lowered, thus lowering only the right end of the base member 48 in FIG. 12 via the arms 50 mounted on the vertically movable shaft 54. A converse rotation of the rotary shaft 56 causes the right end of the base member 48 to be raised.

Figure 14:
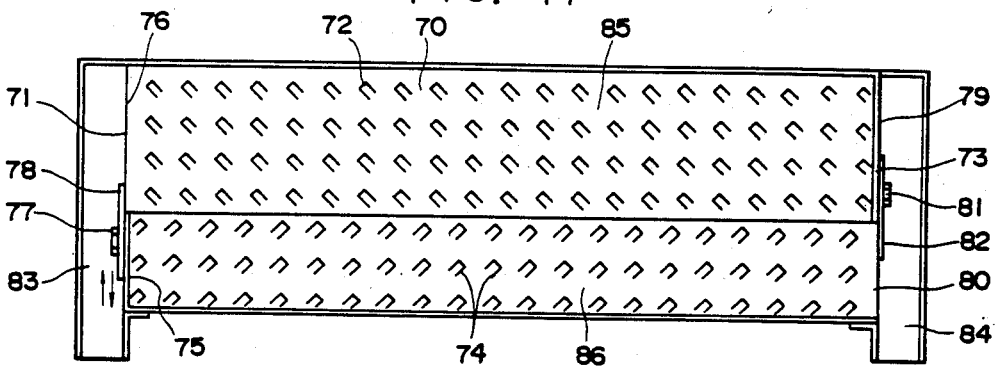
FIG. 14 is a plan view showing the same separating element.

A plurality of separating elements 70 (FIGS. 4A, 4B, 10A, 10B) are provided one above another over the base member 48. FIG. 14 shows the separating member 70. As is shown, its top surface has a number of protuberances 72, 74 inclined obliquely to its opposed sides 71 and 73. Its top surface is rectangular. Its front portion constituting two-third of the entire area has leftwardly inclined protuberances 72, while its rear portion constituting one-third of its area has rightwardly inclined protuberances 74. The side 71 of the rear portion is closed by an upright wall 75. A hulled rice outlet 76 is provided on the side 71 of the front portion of the element. The aperture of the outlet is adjustable by an adjusting plate 78. The adjusting plate 78 is movable forwards and rearwards by loosening a manual screw 77. The other side 73 of the front portion is closed by an upright wall 79. An unhulled rice outlet 80 is provided on the other side 73 of the rear portion. The aperture of the outlet 80 is adjustable by an adjusting plate 82. The adjusting plate 82 is movable forwards and rearwards by loosening a screw 81. A hulled rice outlet gutter 83 is provided on the side 71, while an unhulled rice outlet gutter 84 is provided on the other side 73. The front and rear portions 85 and 86 of the separating element 70 may be formed separately or integrally. In the latter case, the leftwardly and rightwardly inclined protuberances 72 and 74 may be formed on a single stainless steel sheet.

Figure 13:
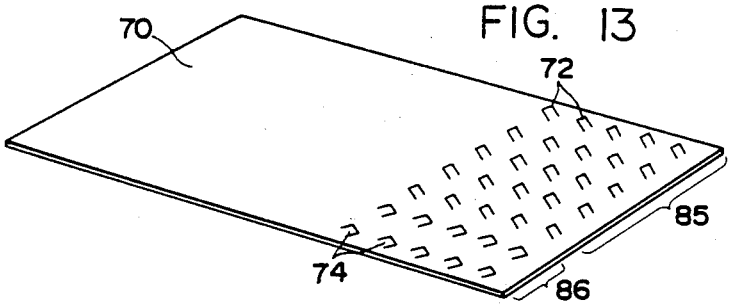
FIG. 13 is a perspective view showing a separating element.

FIG. 13 shows a separating element 70 having leftwardly and rightwardly inclined protuberances 72 and 74 which are press formed at a time.

Since the hulled rice is far heavier than the unhulled rice, the area of the front portion 85 of the element with the leftwardly inclined protuberances 72 is made far greater than the area of the rear portion 86 with the rightwardly inclined protuberances 74.

As shown in FIG. 4A, a plurality of separating elements 70 are provided as a stack. The distributor 87 which is provided above the stack of separating elements 70 has branch passages leading to the individual separating element 70.

Figure 16:
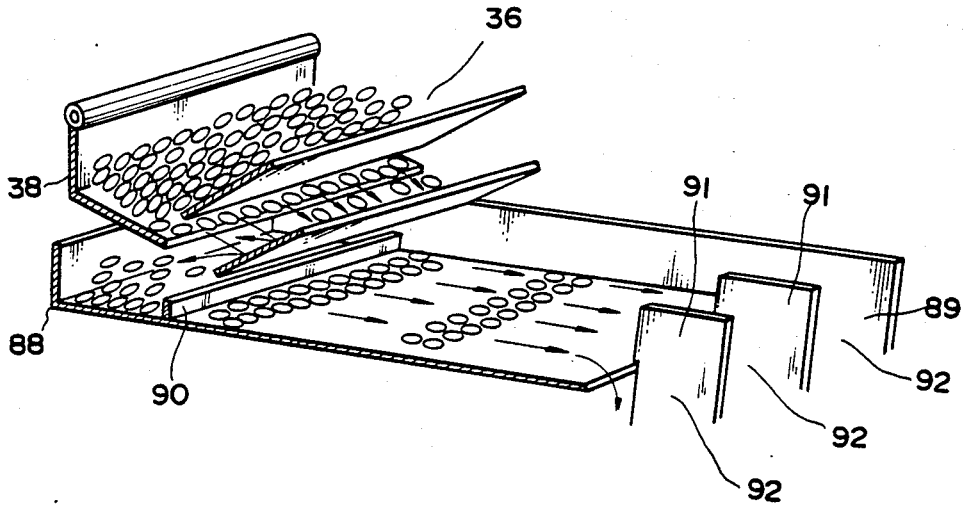
FIG. 16 is a fragmentary perspective view showing a distributor.

One end of the distributor 87 is slightly higher in level than the other end 89. The width of the one 88 (FIGS. 4A, 4B, 16) is substantially the same as the width of the air-blow separating section 3. The distributor 87 has a uniform width from the end 88 to the end 89. It has a transversal ridge 90 provided at an intermediate position between the ends 88 and 89. It also has partitioning walls 91 (FIGS. 10A, 10B, 16) provided at the end 89 in a number equal to the number of the separating elements 70, whereby branch passages 92 leading to the individual separating elements 70 are formed.

In the example of FIG. 4B, a receiving gutter 116 is provided with its top opening disposed beneath the lower end of the passage 114. The lower open end of the receiver gutter 116 faces the top opening of a hopper 115 leading to the uppermost separating element 70. With the change-over valve 113 switched to the position shown by phantom lines, the process grain is led through the passage 114 into the receiver gutter 116 and thence into the hopper 115 to be led to the uppermost separating element 70 only.

The hulled rice take-out lifter 5 has a finished rice inlet 93 provided at its lower end and a discharge duct 94 provided at the top. A change-over valve 95 is provided at the outlet end of the discharge duct 94. It switches a return duct 96 and a take-out duct 97. The return duct 96 is led to a storage tank 98 having a lower neck 99 communicating with a duct 100. An on-off valve 101 is provided in the duct 100 near the lower end thereof. An adjustment valve 102 with an adjusting screw 103 is provided beneath the on-off valve 101.

The lower end 104 of the duct 100 faces a top opening 105 of a gutter leading to the uppermost separating element 70.

The unhulled rice lifter 1 has a return inlet 106 (FIGS. 10A, 10B) provided at the lower end and a discharge gutter leading from its top to the supply tank 8. The air-blow separating section 3 has a prematured grain outlet 109 (FIGS. 4A, 4B) and an adjustment member 110.

Figure 10A:
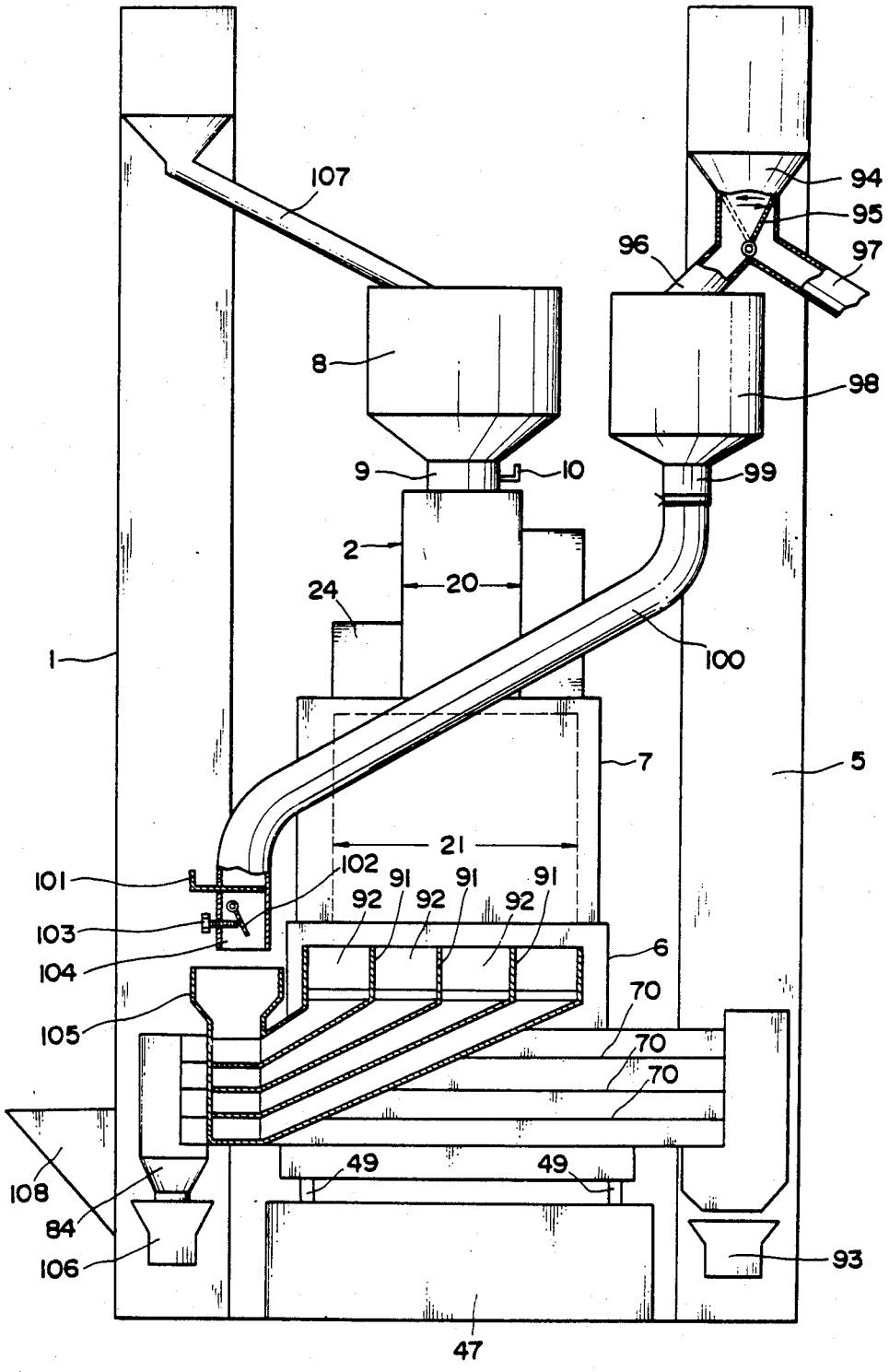
FIG. 10A is an elevational view showing a mechanism for returning inseparable rice.
Figure 10B:
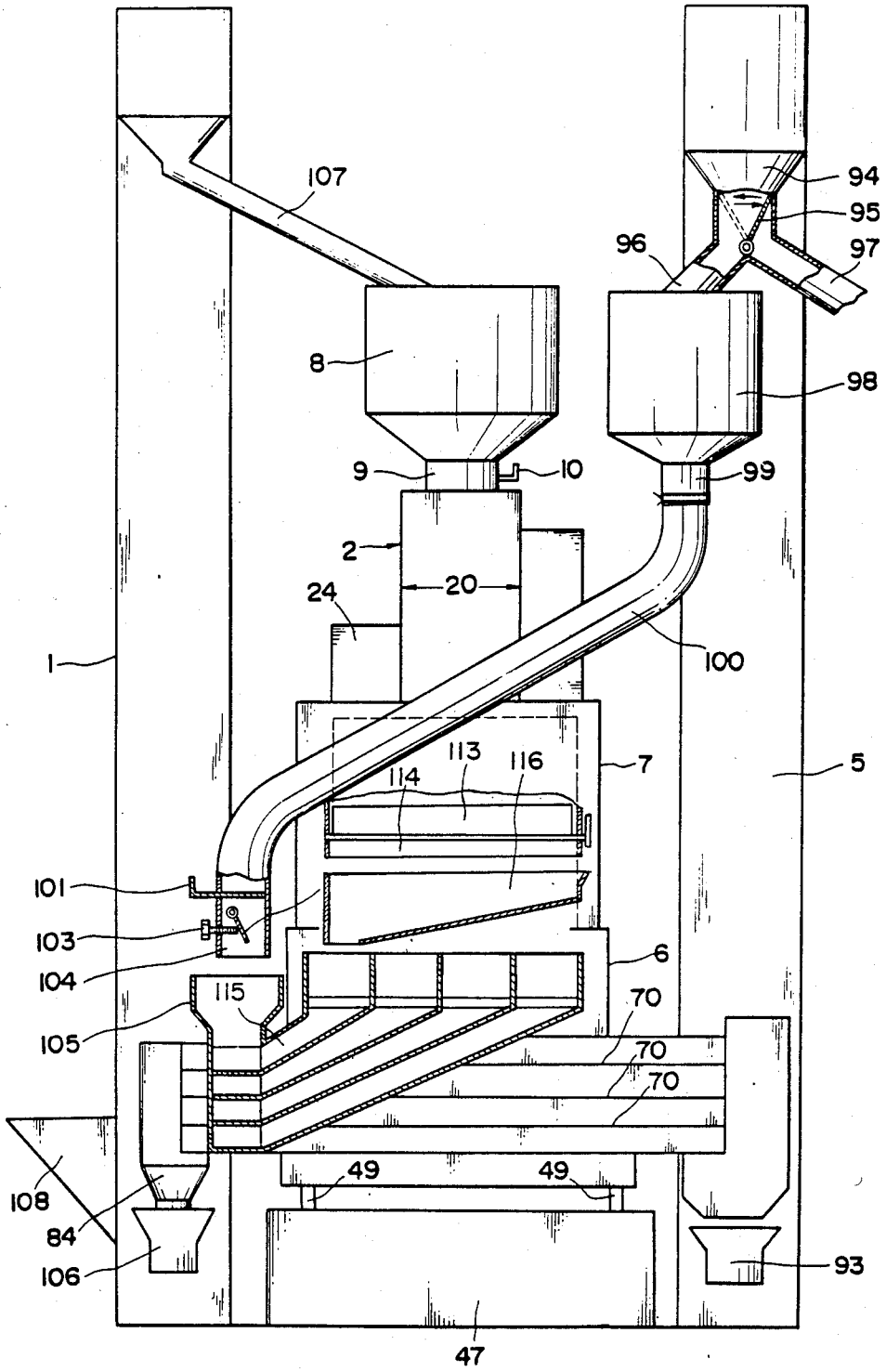
FIG. 10B is a view similar to FIG. 10B but showing a different example.
Figure 11:
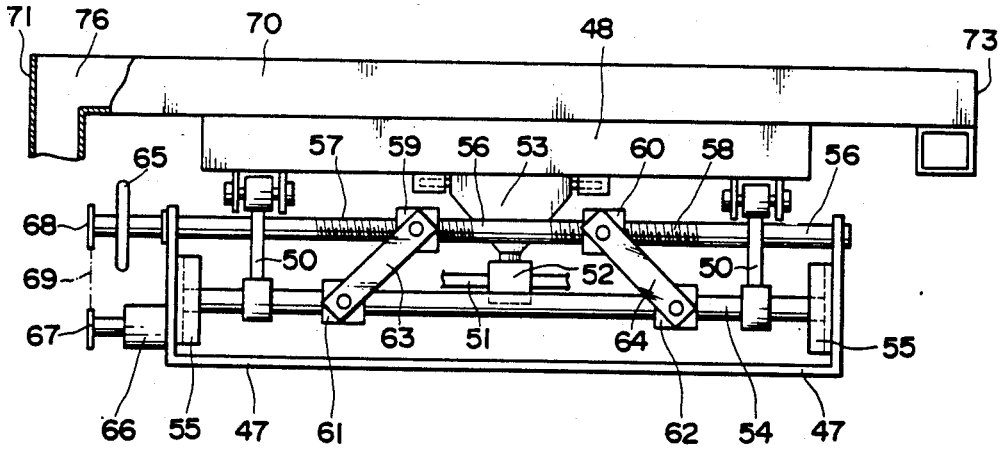
FIG. 11 is a side view showing a separating element adjusting section.

In operation, unhulled rice a charged into a side hopper 108 provided on the lifter 1 adjacent to the lower end thereof, with the change-over valve 113 in the position of the solid lines in FIG. 4B, the on-off valve 101 (FIGS. 10A, 10B) fully closed and the change-over valve 95 in the position of the solid lines in FIG. 10A, is lifted through the lifter 1 and thence allowed to flow along the discharge gutter 107 so that it is charged into the supply tank 8. By manually opening the adjustment valve 10 provided in the lower neck 9 of the supply tank 8, the supplied unhulled rice a falls and is delivered by the rotating, delivery roller 14 at a low rate onto the inclined plate 15. It flows over the inclined plate 15 to be supplied therefrom into between the pair rubber rollers 16 and 17 and is subjected to a rice-hulling action therebetween before being discharged to the discharge side 18. The process grain emerging from between the rubber rollers 16 and 17 strikes the dispersing member 19 and jumps therefrom beyond the front upright edge 26 thereof to strike and be reflected by the reflector 27. The reflected grain falls onto the inclined guide plates 28 and 29 to flow therealong and fall through the gap therebetween into the air-blow separating chamber 33 therebeneath. While the hulling section 2 has a small width just sufficient to accommodate the rubber rollers 16 and 17, the process grain striking and reflected by the reflector 27 is dispersed in the axial direction of the rubber rollers 16 and 17 to enter the dispersing spaces in the side covers 24 and 25 provided on the opposite side walls of the frame of the hulling section 2. It is thus dispersed to the width 21 of the air-blow separating section 3 before it is supplied thereto. The inclined guide plates 28 and 29 have such gentle slopes that the matter supplied thereto will not flow theralong by its own weight. However, they are mounted inside the air-blow separating casing 111 in the air-blow separating section 3, and the air-blow separating casing 111 is quickly vibrated in the directions of arrows with the rotation of the shaft 31, through the excentric cam 43 mounted on the shaft 31 and the connecting rod 44 having one end secured to its side wall in the example of FIG. 5A and through the outer ring 112 of the excentric cam 43 directly secured to it in the example of FIG. 5B. Thus the process matter flows smoothly over the inclined guide plates 28 and 29 even though the slopes thereof are gentle. As the process matter flows over the guide plates 28 and 29, it is dispersed in the width direction thereof, so that it enters the air-blow separating chamber 33 uniformly in the width direction thereof. The transversal air blower 30 is blowing air drawn through the air opening 32 into the air-blow separating chamber 33, whereby light hulls c are blown up into the hull withdrawal duct 34 to be withdrawn and discharged from the blower 35.

The mixture rice consisting of the unhulled and hulled rice a and b falling through the air-blow separating chamber 33 is stored in the hopper 36. At this time, prematured grain is separated and taken out from the prematured grain outlet 109.

When the mixture rice stored in the hopper 36 reaches a predetermined quantity, the arm 39 is moved down against the spring force of the spring 30, causing the on-off valve 38 to be turned about the shaft 37 and thus be opened. The grain thus is allowed to fall uniformly in the width direction. The falling grain is supplied to the distributor 87. It is dispersed over the full width of the distributor 87 for the distributor 87 is quickly oscillated back and forth through the rod 53 with the rotation of the eccentric cam 52 on the drive shaft 51. As it is caused to flow over the distributor 87 from one end 88 to the other end 89, it jumps the transversal ridge 90 and is dispersed further uniformly and is led through the branch passages 92 defined by the partitioning walls 91 provided at the other end 88 to the separating elements 70.

Figure 15:
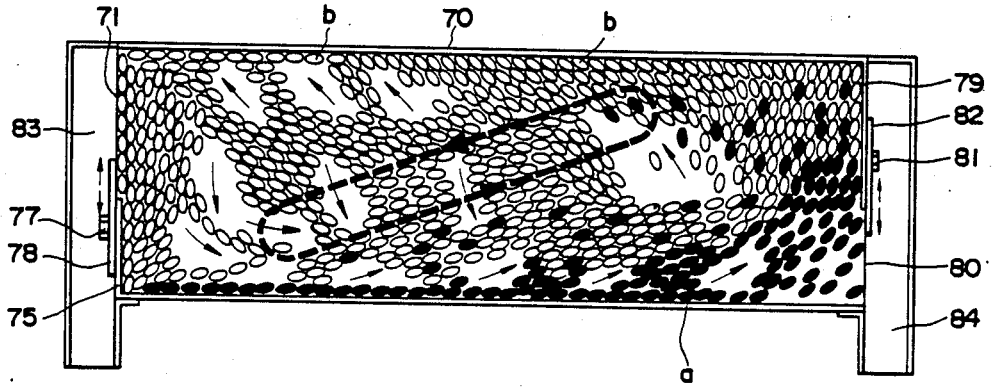
FIG. 15 is a plan view showing the same separating element in operation.

The separating elements 70 are reciprocated with the base member 48 back and forth in the horizontal directions as shown by arrows in FIG. 12 via the rod 53 mounted on the eccentric cam 52 with the rotation thereof caused with the rotation of the drive shaft 51. Since the angle $\theta$ between the arm 49 supporting the base member 48 and rod 53 is smaller than the right angles, the elements 70 return quickly, that is, the elements 70 are moved forwardly at a low speed and rearwardly at a high speed. With the back-and-forth reciprocation of the separating elements 70 in the manner as noted above, the mixture rice consisting of the unhulled and hulled rice a and b supplied to the elements 70 through the branch passages 92 is separated in the manner as shown in FIG. 15 by virtue of a phenomenon which is described in greater detail in my copending application Ser. No. 522,093, filed Aug. 11, 1983, now U.S. Pat. No. 4,583,645 and the contents of which are hereby incorporated herein to the extent necessary for a satisfactory understanding of the function of the separating elements 70. The separated hulled rice b is led to the hulled rice outlet gutter 83 through the hulled rice outlet 76. From the hulled rice outlet gutter 83, it enters the hulled rice inlet 93 and is lifted through the hulled rice take-out lifter 5. With the change-over valve 95 held in the position of the phantom lines, it can be taken out through the take-out duct 97. The separated unhulled rice a, on the other hand, is led by the rightwardly inclined protuberances 74 to the unhulled rice outlet 80 and thence to the unhulled rice outlet gutter 84. From the unhulled rice outlet gutter 84, it enters the return inlet 106 of the lifter 1 to join the unhulled rice a supplied thereto.

Toward the end of the operation, the quantity of the mixture rice stored in the hopper 36 is reduced to such an extent that it can no longer be distributed to the individual separating elements 70. At this time, the change-over valve 113 is switched to the position of the phantom lines in FIG. 4B, whereby the grain to be shifted is supplied through the passage 114, receiver gutter 116 and hopper 115 to the uppermost separating element 70 only. Further, toward the end of the operation the rate of supply to each separating element becomes too low to obtain the separating effect of the element 70 so that both the unhulled and hulled rice a and b flow out through the unhulled rice outlet 80 to the unhulled rice outlet gutter 84. The mixture rice may be stored into the storage tank 98 through the return duct 96 by switching the change-over valve 95 to the position of the solid lines in FIGS. 10A and 10B. By opening the on-off valve 101, the stored mixture rice may be supplied for separating to the uppermost separating element 70 through the top opening 105.

What is claimed is:

1. A separating element for a vibratory grain separator, said element consisting of a single metal plate having a rectangular shape, said separating element having a hulled rice outlet and an unhulled rice outlet, said outlets being provided on the opposite side edges, respectively, of said separating element, a major portion of the top surface of said separating element being formed with a first plurality of spaced, hulled rice guiding protuberances inclined obliquely to said hulled rice outlet for moving the hulled rice toward said hulled rice outlet and a minor portion of said top surface of said element having formed thereon a second plurality of spaced, unhulled rice guiding protuberances fewer in number than said first plurality, and inclined obliquely to said unhulled rice outlet for moving the unhulled rice toward said unhulled rice outlet.

2. A separating element for a vibratory grain separator, said element being made from a single metal plate having a rectangular shape, and said separating element having front, rear and opposite side upright walls, one of said side walls having therein a notch serving as a hulled rice outlet, the other of said side walls having therein a notch serving as an unhulled rice outlet, the top surface of said separating element except for said upright walls, being formed with a first plurality of hulled rice guiding proturberances for moving the hulled rice toward said hulled rice outlet, and a second plurality of unhulled rice guiding protuberances for moving the unhulled rice toward said unhulled rice outlet, said first plurality of protuberance being inclined obliquely to said front wall and to said one side wall, respectively, and said second plurality of protuberances being inclined obliquely to said front wall and to said other side wall respectively.

* * * * *